US006978368B1

(12) United States Patent
Miyatake et al.

(10) Patent No.: US 6,978,368 B1
(45) Date of Patent: Dec. 20, 2005

(54) METHOD FOR DETECTING INVALID ELECTRONIC STORAGE MEDIA AND CARD SYSTEM USING THE METHOD

(75) Inventors: Manabu Miyatake, Kawasaki (JP); Michio Sato, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/412,786

(22) Filed: Oct. 5, 1999

(30) Foreign Application Priority Data

Oct. 6, 1998 (JP) ..... 10-283736

(51) Int. Cl.[7] ..... H06F 1/24

(52) U.S. Cl. ..... 713/168; 713/161; 713/165; 713/166; 713/167

(58) Field of Search ..... 713/168, 161, 713/165, 166, 167; 360/69; 704/9

(56) References Cited

U.S. PATENT DOCUMENTS

| | | | | |
|---|---|---|---|---|
| 5,103,079 A | | 4/1992 | Barakai et al. | |
| 5,182,709 A | * | 1/1993 | Makus | 704/9 |
| 5,396,624 A | | 3/1995 | Campbell, Jr. | |
| 5,710,798 A | * | 1/1998 | Campana, Jr. | 375/347 |
| 6,075,669 A | * | 6/2000 | Takayama | 360/69 |

FOREIGN PATENT DOCUMENTS

| | | |
|---|---|---|
| DE | 3736190 | 5/1988 |
| EP | 0378349 | 7/1990 |
| JP | 63-298681 | 5/1987 |
| JP | 06-274720 | 3/1993 |
| JP | 09-091303 | 9/1995 |
| JP | 10-187826 | 12/1996 |

OTHER PUBLICATIONS

T. Ottmann et al, "Algorythmen and Datenstrukturen," 1990, BI Wissenschaftsverlag XP 002194763, pp. 183–185.

G. Gardarin et al, "Relational Databases and Knowledge Bases," 1989, Addison–Wesley Publishing Company XP 002194764, Chapter 2.4.1.

"Information Processing Handbook'—New Edition", Information Processing Society of Japan, Nov. 25, 1995, pp. 99.

* cited by examiner

*Primary Examiner*—Thomas R. Peeso
(74) *Attorney, Agent, or Firm*—Mattingly, Stanger, Malur & Brundidge, P.C.

(57) ABSTRACT

In a method for detecting invalid electronic storage media each storing therein identification information recognized as an invalid electronic storage medium, the individual identification information on the invalid electronic storage media, grouped by hash values, is registered as a list. On the other hand, the individual identification information and hash information are assigned to each of the electronic storage media. The method reads the individual identification information and the group value information in response to a usage request for the electronic storage medium and checks if the individual identification information on the electronic storage medium is registered with the group corresponding to the hash value that was read. If the individual identification information corresponding to the hash value is found, the method judges that the requested electronic storage medium is invalid; if the individual identification information corresponding to the hash value is not found, the method judges that the requested electronic storage medium is valid.

4 Claims, 5 Drawing Sheets

FIG. 2A

21a

| ID + HASH VALUE |
|---|
| a a a a AA |
| b b b b AA |
| c c c c BB |
| d d d d CC |
| ⋮ |

FIG. 2B

21b

| ID |
|---|
| a a a a |
| b b b b |
| c c c c |
| d d d d |
| ⋮ |

FIG. 3

41

| HASH VALUE | ID |
|---|---|
| AA | a a a a<br>b b b b |
| BB | c c c c |
| CC | d d d d |
| ⋮ | ⋮ |

METHOD FOR DETECTING INVALID ELECTRONIC STORAGE MEDIA AND CARD SYSTEM USING THE METHOD

BACKGROUND OF THE INVENTION

The present invention relates to a method for detecting invalid electronic storage media with individual identification information (ID) that is recognized as an invalid electronic storage medium and to a card system using the method. More particularly, the present invention relates to a method for detecting an invalid card in gate devices such as an automatic ticket gate wherein IC cards, or smart cards, are used, and to a technology that may conveniently be applied to a card system.

An electronic storage medium with individual identification information ID that is recognized as an invalid electronic storage medium is, for example, an invalid card. The invalid card refers to a card that has not yet expired but its use is prohibited because, for example, the user has lost the card.

Conventionally, a card is checked before use for validity to prevent the above-mentioned invalid card from being used.

The means that is in practical use today for detecting invalid cards include a method in which an inquiry about the validity of cards is sent to the host computer. For example, CAFIS (Credit And Finance Information System) is available for use as a method for checking the validity of cards issued from financial institutions.

As a means for detecting invalid cards without making an inquiry, there are also methods for detecting invalid cards by downloading a list of invalid IDs onto a terminal and then checking the list for a card that is to be examined. One of the methods which check the list for a card to be examined uses a hash function. The search method with the use of a hash function is disclosed, for example, in "Information Processing Handbook—New Edition", Information Processing Society of Japan, pp. 99, Nov. 25, 1995.

In the method where a hash function is used for detecting invalid cards, a terminal or an IC card application unit reads an ID from an IC card and, for the IC card that was read, calculates a hash value using the predetermined hash function (This function performs an arithmetic operation for dividing IC cards into a predetermined groups according to the number of IC cards or the purpose of IC cards).

Then, the method checks the by-hash-value hot list (black list), which contains invalid IC card IDs classified by hash value, to see if the IC card to be checked is in the group corresponding to the calculated hash value. If the group corresponding to the hash value contains the ID of the IC card to be checked, the method performs invalid card processing; if the group corresponding to the hash value does not contain the ID of the IC card to be checked, the method performs valid card processing.

In this way, the method uses the hash function to calculate the hash value from the ID of an IC card. Then, it compares, one at a time, the IDs in the hash value group corresponding to the calculated hash value listed on the invalid card ID list with the ID of the card to be checked to detect if the IC card is an invalid card.

SUMMARY OF THE INVENTION

Recently, cards are used in a variety of fields. As they become popular and the number of cards increases, the number of invalid cards also increases. A need therefore exists for processing a larger amount of data quickly during invalid card checking processing.

Conventionally, an attempt has been made to reduce the amount of search and to increase the detection speed by dividing invalid IC cards into a predetermined number of groups with the use of the above-mentioned hash function.

However, in the detection method that uses the hash function, the hash function that produces hash values for evenly distributing invalid cards into relatively many hash value groups requires a large amount of calculation. One of the problems with such a function is that the total amount of time for checking a card becomes large. For this reason, the conventional technology does not meet the requirements for automatic ticket gates used for rail road, bus, airplane, and public/entertainment facilities.

As described above, the by-hash-value hot list (hereinafter called "hash list") containing invalid card IDs is a list containing invalid card IDs grouped by hash value. Because cards are not always issued regularly and therefore the IDs are not always distributed evenly, invalid cards are not always classified into, and distributed among, the groups evenly. The number of invalid cards classified according to the hash value varies from group to group, sometimes with many cards in a specific group. Thus, the problem is that invalid card detection cannot be performed quickly in a group in which many invalid cards are registered.

The present invention seeks to solve the problems associated with the conventional art described above. It is an object of the present invention to provide a technology capable of detecting invalid electronic storage media (invalid cards) quickly.

The following overviews some of typical inventions disclosed in this application.

A method for detecting invalid electronic storage media, each storing therein identification information recognized as an invalid electronic storage medium, registers the individual identification information on the invalid electronic storage media as a list, the individual identification information being grouped into a plurality of groups; assigns the individual identification information and group value information to each of the electronic storage media; reads the individual identification information and the group value information in response to a usage request for the electronic storage medium; checks one of the plurality of groups if the individual identification information on the electronic storage medium is registered therewith, the one of plurality of groups corresponding to the group value information that was read; and judges that the requested electronic storage medium is invalid if the individual identification information corresponding thereto is found and judges that the requested electronic storage medium is valid if the individual identification information corresponding thereto is not found. It should be noted that the identification information and the group value information need not be read separately but that they may be read at a time. In such a case, the identification information may be assumed to include both the identification information and the group value information but, in essence, it is a pair of the individual identification information and the group value information. It is assumed that individual identification information (ID) is assigned to each card such that the ID is unique.

A card system comprises a plurality of cards each having unique identification information; a card management system for issuing and managing the cards; and a card application unit, connected to the card management system, for reading data from the card in response to a usage request, the card comprising the individual identification information and group value information identifying a group to be searched, the card management system comprising card issuance and management means for issuing and managing the cards, hot list creation means for creating a hot list listing invalid cards, and communication means for communicating with the card application unit via the communication line, the card application unit comprising read means for reading the individual identification information and the group value from the card, by-group list creation means for creating a by-group list from the hot list distributed from the card management system via the communication line, the by-group list grouped by the group value, invalid card checking means for checking if the card that was read is invalid, card processing means for processing the card based on a result of the invalid card checking means, and communication means for communicating with the card management system via the communication line.

BRIEF DESCRIPTION OF THE DRAWINGS

FIGS. 2A and 2B are diagrams showing examples of the configuration of the hot list 21 shown in FIG. 1.

FIG. 3 is a diagram showing an example of the configuration of the by-hash-value hot list 41 shown in FIG. 1.

DESCRIPTION OF THE EMBODIMENTS

Some embodiments of the present invention will be described in detail with reference to the attached drawings.

Figure 1:
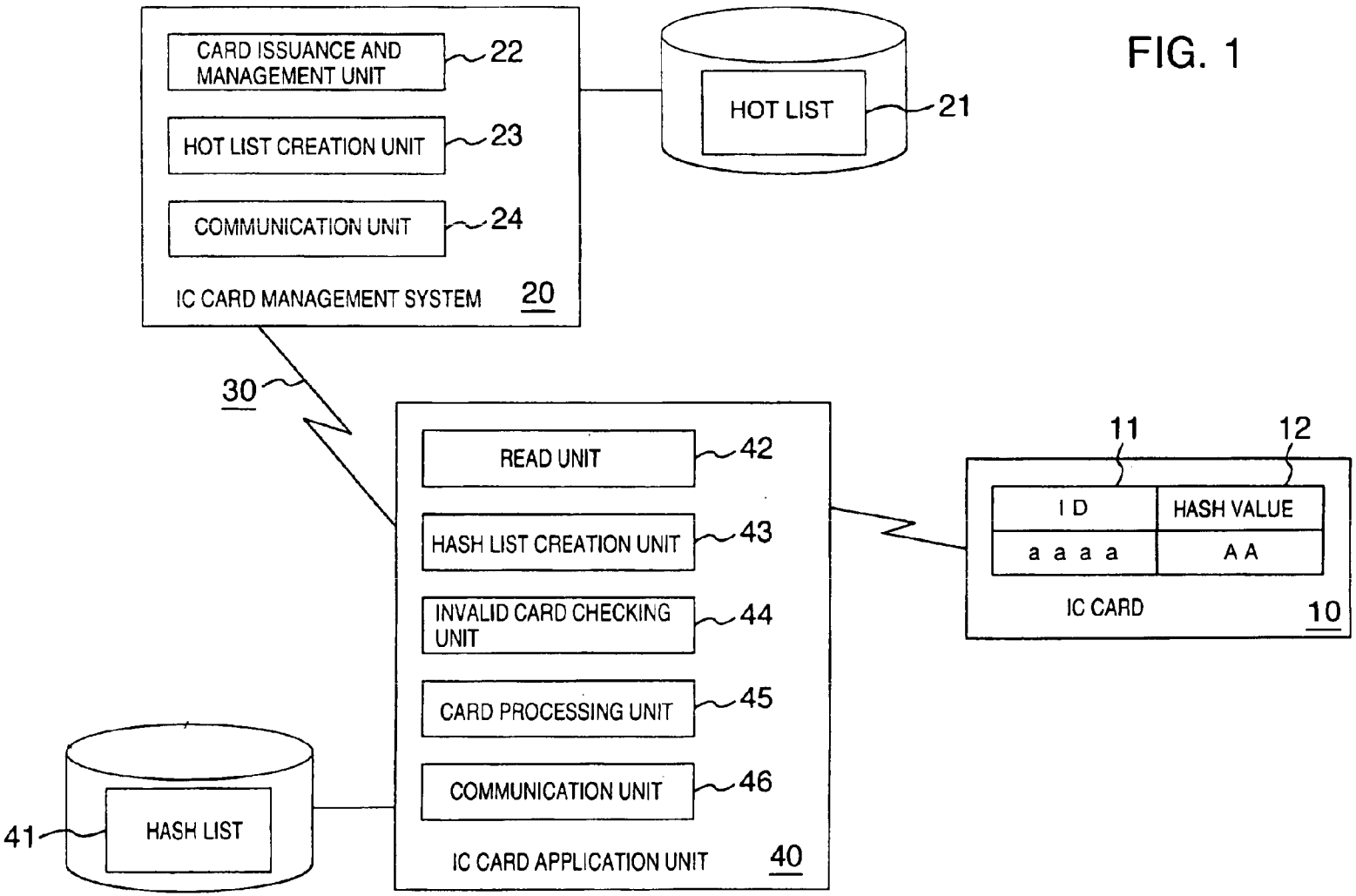
FIG. 1 is a block diagram showing the configuration of an IC card system which implements a method for detecting invalid electronic storage media in accordance with an embodiment of the present invention.

FIG. 1 is a block diagram showing the configuration of an IC card system that implements a method for detecting an invalid electronic storage medium used in one embodiment of the present invention.

The IC card system shown in FIG. 1 comprises an IC card management system 20 and an IC card application unit 40. The IC card management system 20 issues and manages an IC card 10 and creates an invalid card list (hereafter called a hot list). The IC card application unit 40 is connected to the IC card management system 20 via a communication line 30 and reads data from the IC card 10 either in the contact mode or in the non-contact mode for processing.

The IC card 10 contains therein individual identification information (ID) 11 and a hash value 12 assigned by a card issuance and management unit 22, for example, in the format "aaaaAA". When the card issuance and management unit 22 issues the IC card 10, it calculates the hash value 12 from the ID using a hash function.

The IC card management system 20, composed of one or more computers, comprises the card issuance and management unit 22 that issues and manages the IC card 10 to which the ID 11 and the hash value 12 are assigned, a hot list creation unit 23 that creates a hot list 21 listing invalid cards, and a communication unit 24 that communicates with the IC card application unit 40 via the communication line 30. Although the IC card management system 20 is shown in FIG. 1 as one block, the card issuance and management unit 22 and the hot list creation unit 23 may be in two separate networked computers which are remotely located.

FIGS. 2A and 2B show the configuration examples 21*a* and 21*b* of the hot list 21 described above.

The hot list 21*a* shown in FIG. 2A contains combinations of individual identification information (ID), "aaaa", "bbbb", "cccc", and "dddd", of invalid IC cards and hash values, "AA", "BB", and "CC", assigned by the IC card management system 20 according to each ID during card manufacturing or card issuance. An example of such a combination is "aaaaAA".

Two types of information given above, that is, "aaaa", "bbbb", "cccc", and "dddd" and "AA", "BB", and "CC", schematically represent information. The number of digits and the format shown above are irrelevant to the content of information. The hash values "AA", "BB", and "CC" are calculated from the IDs by the card issuance and management unit 22 using the predetermined hash function. These hash values are assigned by the card issuance and management unit 22 during card manufacturing or issuance.

FIG. 2B shows another configuration example 21*b* of the hot list 21. The hot list 21*b* contains "aaaa", "bbbb", "cccc", and "dddd" that are invalid IC card IDs. The hash values of these IDs, if required, may be calculated by executing the hash function using the IDs.

Normally, the card issuance and management unit 22 sequentially assigns the hash values 12 to the IDs 11 during card issuance. However, when the card issuance and management unit 22 finds that there is a bias in the number of IDs registered with the groups of the hash value 12 contained in the hot list 21 and the bias is larger than the predetermined limit or when, during a regular check (monthly or yearly) for a bias, the card issuance and management unit 22 finds that there is a bias and the bias is larger than the predetermined limit, it assigns to a newly-issued IC card an ID that will not produce the hash value of a group with which many IDs are already registered so that the IDs are distributed equally among the hash values 12.

The IC card application unit 40 comprises a read unit 42 that reads the ID 11 and the hash value 12 from the IC card 10, a hash list creation unit 43 that creates a hash list 41, which is classified according to the hash values 12, from the hot list 21 distributed by the IC card management system 20 over the communication line 30, an invalid card checking unit 44 that checks if the card that was read is valid, a card processing unit 45 that processes the IC card 10 based on the result of the invalid card checking unit 44, and a communication unit 46 that communicates with the IC card management system 20 over the communication line 30.

The IC card management system 20 may distribute the hot list 21 either at a regular interval or each time the hot list 21 is updated. The hot list 21 that is in the format of the hot list 21*a* shown in FIG. 2A may be directly downloaded. On the other hand, the hot list 21 that is in the format of the hot list 21*b* shown in FIG. 2B must be downloaded and then the hash value must be calculated for each ID.

FIG. 3 is a diagram showing an example of the configuration of the above-described hash list 41.

As shown in FIG. 3, the hash list 41, created based on the hot list 21, contains IDs grouped by hash value "AA", "BB", "CC", and so on.

When the user uses the IC card 10, the IC card application unit 40 reads a pair of the ID 11 and the hash value 12 from the IC card 10 and searches the hash list 41 with the hash value 12 as the key to check if the IC card 10 is invalid.

Although the embodiment shown in FIG. 1 comprises one IC card application unit 40 and one IC card 10, it is to be readily understood that there may be a plurality of IC card application units and a plurality of IC cards.

Figure 4:
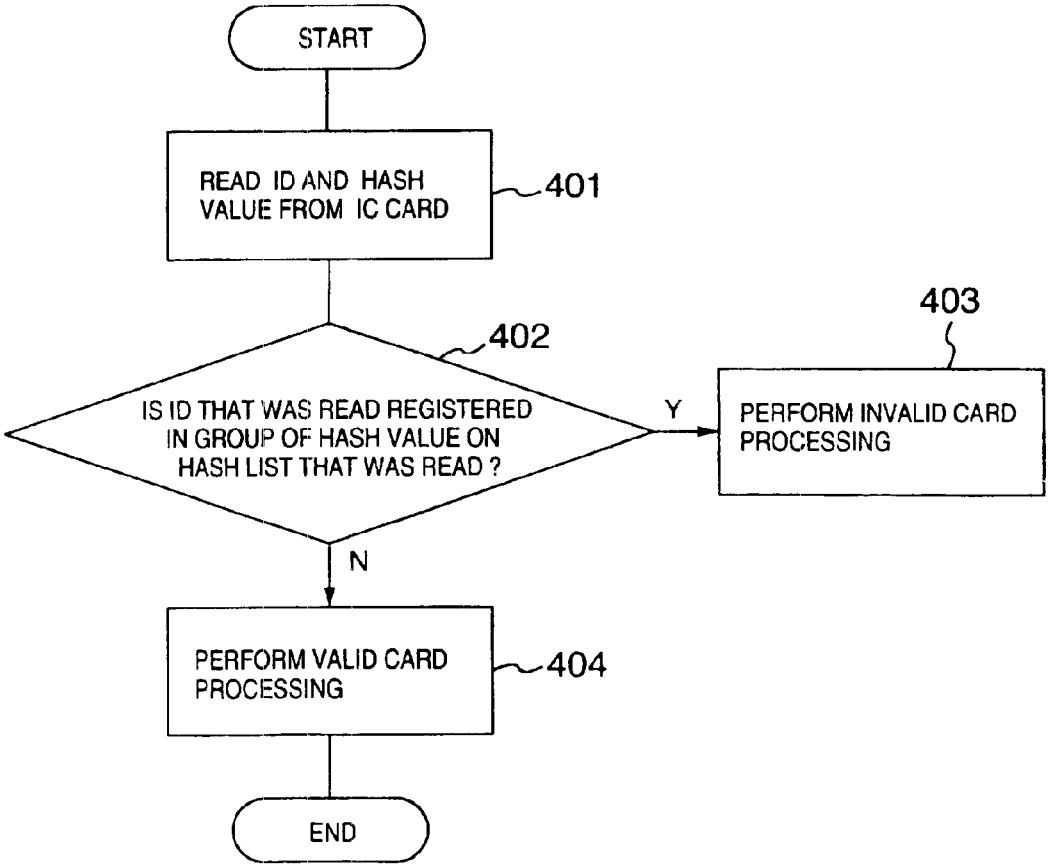
FIG. 4 is a flowchart illustrating the method for detecting invalid cards used in the system shown in FIG. 1.

Next, how the IC card application unit 40 detects an invalid card will be described below. FIG. 4 is a flowchart describing how to detect an invalid card.

As shown in FIG. 4, the method for detecting an invalid card used in the embodiment performs the steps described below. First, the read unit 42 reads both the ID 11 and the hash value 12 from the IC card 10 in response to an IC card usage request from the user (step 401). The invalid card checking unit 44 checks the hash list 41 for the hash value 12 that was read (step 402). If the data corresponding to the hash value 12 includes the ID 11 of the IC card 10, the card processing unit 45 performs invalid card processing (step 403); if the data corresponding to the hash value 12 does not include the ID 11 of the IC card 10, the card processing unit 45 performs valid card processing (step 404). Note that the ID 11 and the hash value 12 need not be read separately but that they may be read at a time. In such a case, the ID 11 may be assumed to include both the ID 11 and the hash value 12 but, in essence, it is a pair of the ID 11 and the hash value 12.

As described above, the present invention eliminates the need for hash value calculation, making it possible to detect invalid cards more quickly than the conventional method.

Next, the card issuance processing of the card issuance and management unit 22 will be described.

Figure 5:
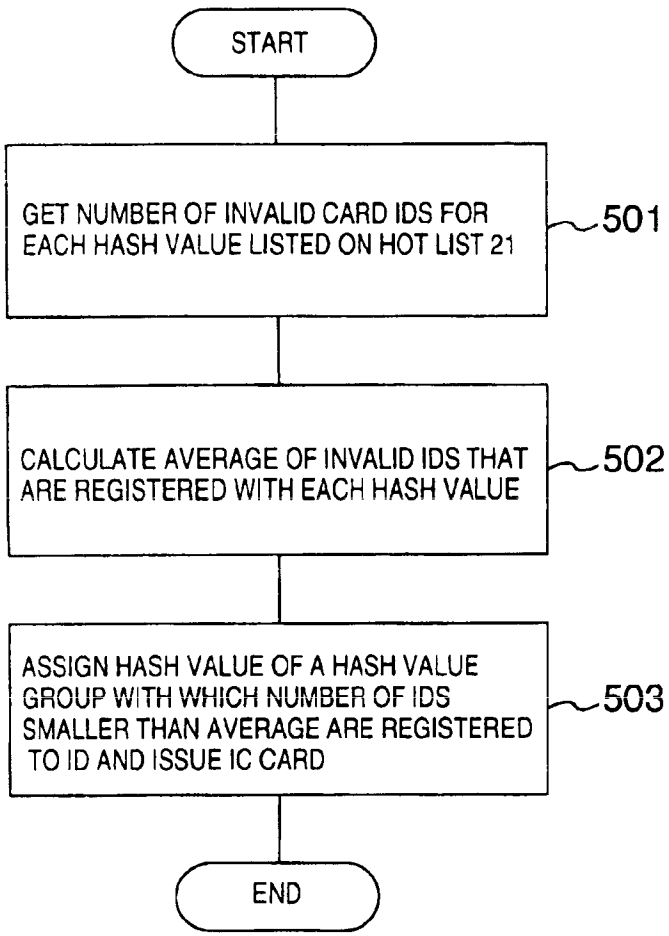
FIG. 5 is a flowchart illustrating the card issuance processing used in the system shown in FIG. 1.
Figure 6:
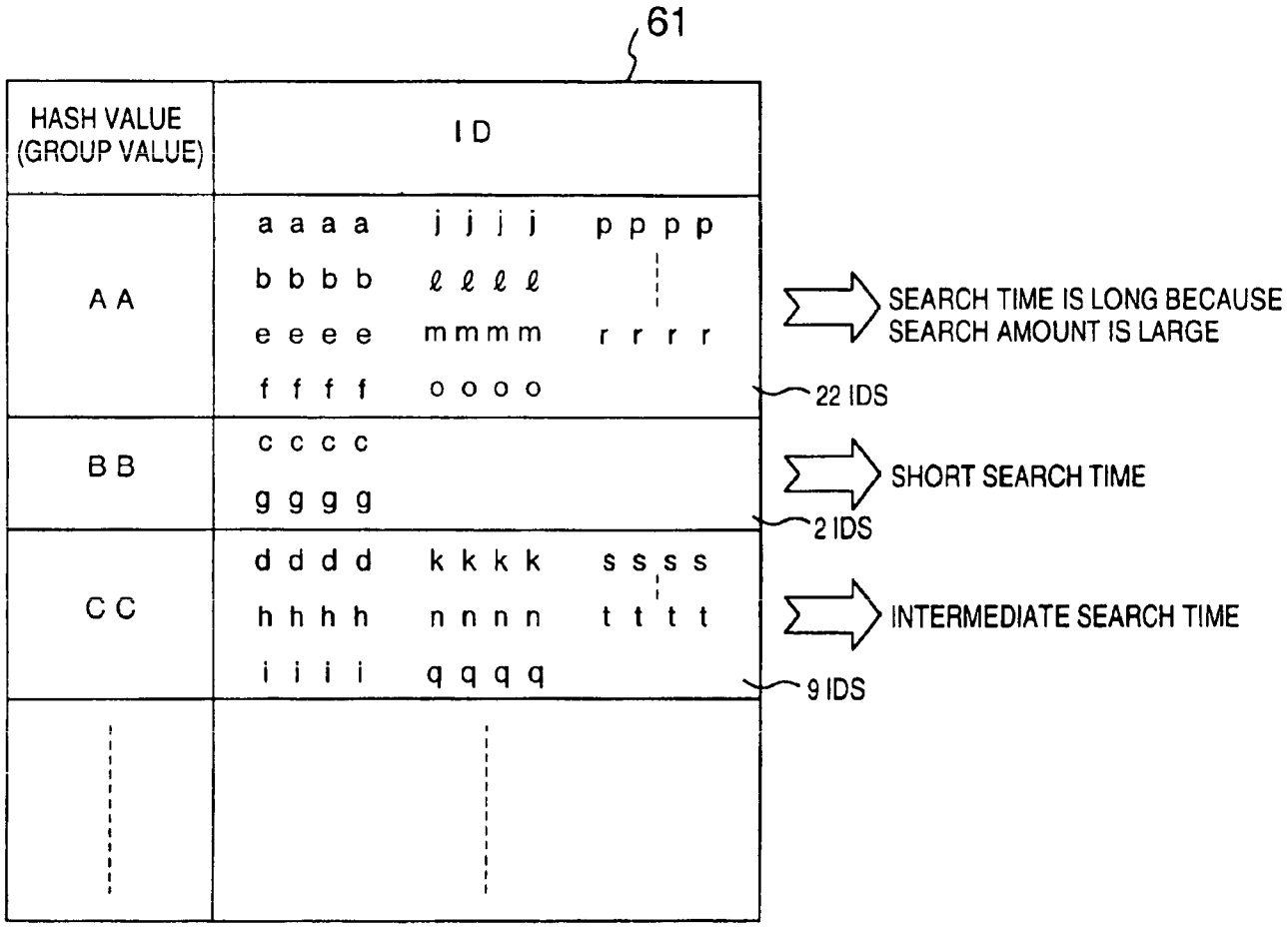
FIG. 6 is a diagram showing the processing of hash values 12 during the card issuance processing shown in FIG. 5.

FIG. 5 is a flowchart showing card issuance processing, and FIG. 6 is a diagram illustrating how hash values 12 are assigned during card issuance processing.

As shown in FIG. 5, the card issuance and management unit 22 gets the number of invalid card IDs for each hash value group listed on the hot list 21 during card issuance processing performed in this embodiment (step 501). That is, the unit creates a list 61 similar to the hash list 41.

Then, the card issuance and management unit 22 calculates the average of the invalid IDs that are registered with each hash value group (step 502). When the card issuance and management unit 22 issues an IC card, it assigns an ID 11 that will produce a hash value of a hash value group with which the number of IDs smaller than the average are registered (step 503). At this time, the unit may give priority to the hash value 12 corresponding to the group with which the smallest number of IDs are registered and assign that hash value to the ID 11.

Referring now to FIG. 6, the card issuance processing mentioned above will be briefly described. First, assume that the hash value group "AA" on the list 61 includes 22 invalid card IDs, that the hash value group "BB" includes 2 invalid card IDs, and that the hash value group "CC" includes 9 invalid card IDs, respectively. In this case, if the hash value of a card to be examined is "AA", the card issuance and management unit 22 must search more IDs than it does with the hash value "BB" or "CC" and therefore requires more time. Therefore, the card issuance and management unit 22 calculates the average of the IDs in the groups (in this example, groups "AA", "BB", and "CC") on the list 61 to get the average value of 11. Alternatively, the unit 22 may count the numbers of the IDs in the groups. The unit assigns, not the hash value "AA", but the hash value "BB" or "CC", with which the number of invalid card IDs smaller than the average are registered, to the ID of a new IC card to prevent the number of IDs to be registered with the hash value "AA" from increasing any more. In this case, a special priority may be given to the hash value "BB" with which the smallest number of IDs are registered. In the case where the unit 22 counts merely the numbers of the IDs in the groups, ID of a new card will be selected to be assigned to the group having the smallest number of IDs.

This prevents invalid cards from being registered with a specific group (hash value "AA" in FIG. 6) but distributes them evenly.

The above-mentioned card issuance processing prevents an increase in the invalid card search time caused by registering many entries with a specific hash value group, thus allowing an invalid card to be detected more quickly.

Figure 7:
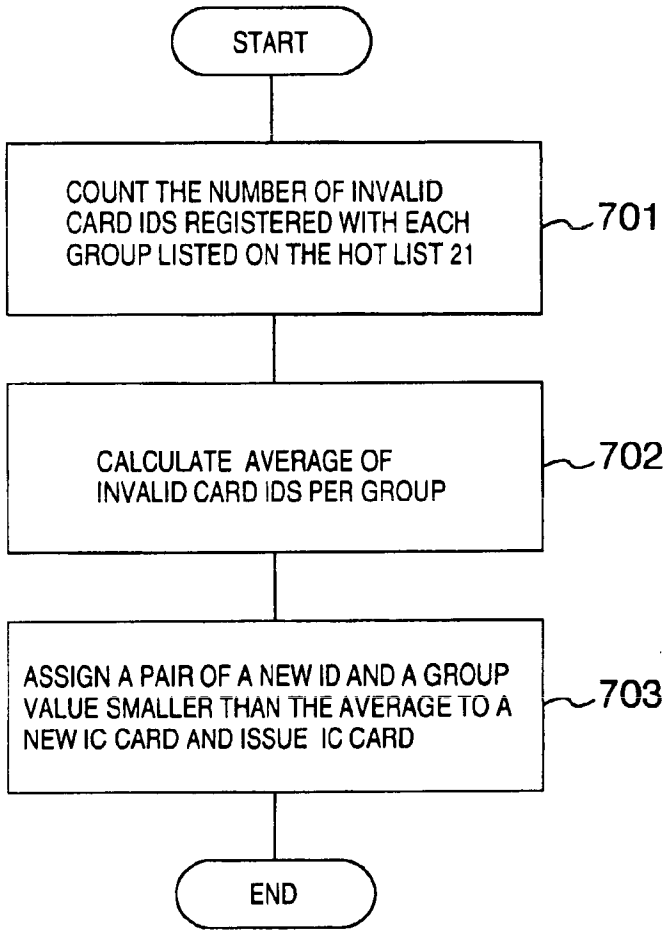
FIG. 7 is a flowchart showing card issuance processing in another embodiment of the present invention.

Referring now to FIGS. 6 and 7, another embodiment of the present invention will be described.

The list 61 shown in FIG. 6 contains invalid card IDs classified according to the hash values calculated by the predetermined hash function. However, instead of calculating "AA", "BB", and "CC" in FIG. 6 as hash values, the same effect may be obtained by defining them as a plurality of groups.

FIG. 7 is a flowchart showing the card generation processing in this embodiment. With reference to the flowchart in FIG. 7, the card generation processing executed by the card issuance and management unit 22 in this embodiment will be briefly described.

First, the card issuance and management unit 22 first counts the number of invalid cards (that is, IDs) registered with each group listed on the list 61 (step 701). Then, the unit calculates the average of invalid cards per group using the total number of registered invalid cards (step 702). The unit assigns a new ID to a new IC card and, at the same time, assigns to the new IC card the value of a group containing the number of IDs smaller than the average, and then issues the new IC card. When assigning the group value, a priority may be given to the group value with which the smallest number of IDs are registered. In addition, in step 703, a new group value may be created and assigned as the group value of the new IC card.

In the card issuance processing shown in the flowchart in FIG. 7, the group value assigned to an IC card cannot be calculated from the ID of the IC card. Therefore, the hot list 21 in this embodiment is limited to the hot list 21*a* shown in FIG. 2A.

The embodiments were described with emphasis on IC cards. However, the method for detecting invalid cards according to the present invention may also be applied to other electronic storage media such as magnetic cards.

The units 22 to 24 and 42 to 46 may be implemented as programs that run on a computer. Those programs are distributed to the user on various recording media such as a floppy disk, CD-ROM, and mask ROM. In this case, these programs are sometimes combined with other programs such as GUI programs.

As an alternative means for the above recording media, the programs may be available for a fee over networks such as the Internet.

While the preferred form of the present invention has been described, it is to be understood that the present invention is not limited to the embodiments but that modifications will be apparent to those skilled in the art without departing from the spirit of the present invention.

What is claimed is:

1. A method for detecting invalid electronic storage media, said method comprising the steps of:

containing individual identification information and group value information in each of said electronic storage media;

holding a list which registers said individual identification information of an invalid electronic storage media in one of a plurality of groups corresponding to said group value information of said individual identification information;

reading said individual identification information and said group value information in response to a usage request for said electronic storage medium;

checking one of said plurality of groups if the individual identification information on the electronic storage medium is registered therewith, said one of plurality of groups corresponding to said group value information that was read; and judging that the requested electronic storage medium is invalid if said individual identification information corresponding thereto is found, and judging that the requested electronic storage medium is valid if said individual identification information corresponding thereto is not found.

2. The method for detecting invalid electronic storage media according to claim 1, further comprising the steps of:

checking the list if there is a bias in the groups grouped by said group value; and if said electronic storage media are concentrated in one specific group, not assigning the group value information on said specific group to the group value information on the newly-issued electronic storage medium.

3. The method according to claim 1, wherein said grouping is performed with each of a plurality of hash values calculated by a predetermined hash function as the group value and wherein said group value of each of said electronic storage media corresponds to the hash value calculated by said hash function using the individual identification information assigned to each of said electronic storage media.

4. The method according to claim 3, wherein said electronic storage medium is an IC card.

* * * * *